US011309650B2

(12) United States Patent
George et al.

(10) Patent No.: US 11,309,650 B2
(45) Date of Patent: Apr. 19, 2022

(54) SEALED CONNECTOR ASSEMBLY

(71) Applicant: Aptiv Technologies Limited, St. Michael (BB)

(72) Inventors: Terry A. George, Salem, OH (US); Eric E. Shasteen, Salem, OH (US); William G. Strang, Warren, OH (US); Daniel F. McNally, Youngstown, OH (US); Patrick J. Reedy, Youngstown, OH (US); Bruce D. Taylor, Cortland, OH (US); Peter T. Bucco, Cortland, OH (US); Kevin Gualandi, Brookhaven, MS (US)

(73) Assignee: APTIV TECHNOLOGIES LIMITED

( * ) Notice: Subject to any disclaimer, the term of this patent is extended or adjusted under 35 U.S.C. 154(b) by 0 days.

(21) Appl. No.: 16/631,385

(22) PCT Filed: Jul. 19, 2018

(86) PCT No.: PCT/US2018/042792
§ 371 (c)(1),
(2) Date: Jan. 15, 2020

(87) PCT Pub. No.: WO2019/027683
PCT Pub. Date: Feb. 7, 2019

(65) Prior Publication Data

US 2020/0144761 A1 May 7, 2020

Related U.S. Application Data

(60) Provisional application No. 62/539,656, filed on Aug. 1, 2017.

(51) Int. Cl.
*H01R 13/52* (2006.01)
*H01R 13/187* (2006.01)
(Continued)

(52) U.S. Cl.
CPC ..... *H01R 13/187* (2013.01); *H01R 13/052* (2013.01); *H01R 13/113* (2013.01);
(Continued)

(58) Field of Classification Search
CPC ..... H01R 13/5219; H01R 13/5221; H01R 13/5208; H01R 13/5216; H01R 13/5205
(Continued)

(56) References Cited

U.S. PATENT DOCUMENTS 5,108,303 A 4/1992 Maeda et al.
5,328,382 A * 7/1994 Pawlicki ..... H01R 13/4364 439/273
(Continued)

FOREIGN PATENT DOCUMENTS

CN 102742090 A 10/2012
EP 2775570 A1 9/2014
(Continued)

OTHER PUBLICATIONS

US 9,553,396 B1, 01/2017, Yang et al. (withdrawn)
(Continued)

*Primary Examiner* — Thanh Tam T Le
(74) *Attorney, Agent, or Firm* — Billion & Armitage

(57) ABSTRACT

A connector assembly includes a female connector body and a male connector body defining a shroud configured to receive the female connector body. The electrical connector assembly further includes a resilient seal axially surrounding a portion of the female connector body. The seal is disposed intermediate the female connector body and the shroud. The connector assembly additionally includes a seal retainer attached to the female connector body. The female connector body defines an outwardly extending retaining ledge on the forward portion of the female connector body. The seal defines an inwardly extending retaining hook engaging the
(Continued)

retaining ledge. A portion of the retaining hook is disposed intermediate the female connector body and the seal retainer.

14 Claims, 6 Drawing Sheets

(51) Int. Cl.

| | |
|---|---|
| ***H01R 13/05*** | (2006.01) |
| ***H01R 13/11*** | (2006.01) |
| ***H01R 13/193*** | (2006.01) |
| ***H01R 13/26*** | (2006.01) |
| ***H01R 13/28*** | (2006.01) |
| ***H01R 13/44*** | (2006.01) |
| ***H01R 13/502*** | (2006.01) |
| ***H01R 13/53*** | (2006.01) |
| ***H01R 13/58*** | (2006.01) |
| ***H01R 13/62*** | (2006.01) |
| ***H01R 13/621*** | (2006.01) |
| ***H01R 13/66*** | (2006.01) |
| ***H01R 24/66*** | (2011.01) |
| ***H01R 43/16*** | (2006.01) |
| *H01R 4/50* | (2006.01) |
| *H01R 13/207* | (2006.01) |
| *H01R 13/633* | (2006.01) |

(52) U.S. Cl.
CPC ..... *H01R 13/193* (2013.01); *H01R 13/26* (2013.01); *H01R 13/28* (2013.01); *H01R 13/44* (2013.01); *H01R 13/502* (2013.01); *H01R 13/5202* (2013.01); *H01R 13/5208* (2013.01); *H01R 13/5219* (2013.01); *H01R 13/53* (2013.01); *H01R 13/5812* (2013.01); *H01R 13/62* (2013.01); *H01R 13/6215* (2013.01); *H01R 13/665* (2013.01); *H01R 24/66* (2013.01); *H01R 43/16* (2013.01); *H01R 4/5091* (2013.01); *H01R 13/207* (2013.01); *H01R 13/6335* (2013.01); *H01R 13/6683* (2013.01); *H01R 2201/26* (2013.01)

(58) Field of Classification Search
USPC ..... 439/271–278, 282–283, 587, 589
See application file for complete search history.

(56) References Cited

U.S. PATENT DOCUMENTS

| | | | | |
|---|---|---|---|---|
| 5,492,487 | A | 2/1996 | Cairns et al. | |
| 5,551,892 | A * | 9/1996 | Endo | H01R 13/443 439/587 |
| 5,613,868 | A * | 3/1997 | Ohsumi | H01R 13/5221 439/275 |
| 5,782,658 | A * | 7/1998 | Maegawa | H01R 13/5219 439/271 |
| 5,911,599 | A * | 6/1999 | Masuda | H01R 13/6592 439/607.58 |
| 5,931,699 | A * | 8/1999 | Saito | H01R 13/5208 439/587 |
| 5,957,715 | A * | 9/1999 | Fukuda | H01R 13/5219 439/271 |
| 6,053,753 | A * | 4/2000 | Kunkle | H01R 13/5221 439/275 |
| 6,152,752 | A * | 11/2000 | Fukuda | H01R 13/506 439/274 |
| 6,186,813 | B1 * | 2/2001 | Tomita | H01R 13/4364 439/271 |
| 6,409,552 | B2 * | 6/2002 | Matsumoto | H01R 13/4362 439/271 |
| 6,464,535 | B2 * | 10/2002 | Murakami | H01R 13/521 439/589 |
| 6,554,623 | B2 * | 4/2003 | Yoshioka | H01R 13/6592 439/98 |
| 6,558,178 | B2 * | 5/2003 | Nakamura | H01R 13/5221 439/271 |
| 6,558,179 | B2 * | 5/2003 | Nakamura | H01R 13/4362 439/275 |
| 6,558,180 | B2 * | 5/2003 | Nishimoto | H01R 9/223 439/271 |
| 6,568,948 | B2 * | 5/2003 | Matsuoka | H01R 13/4361 439/271 |
| 6,752,644 | B2 * | 6/2004 | Shibata | H01R 13/5219 439/271 |
| 6,796,838 | B2 * | 9/2004 | Yoshioka | H01R 13/648 439/607.01 |
| 6,887,106 | B2 * | 5/2005 | Noguchi | H01R 13/6582 439/607.56 |
| 7,204,716 | B1 * | 4/2007 | George | H01R 13/5205 439/275 |
| 7,351,098 | B2 * | 4/2008 | Gladd | H01R 13/6583 439/578 |
| 7,485,002 | B2 * | 2/2009 | Nishide | H01R 13/28 439/607.17 |
| 8,187,036 | B2 * | 5/2012 | Fujiwara | H01R 13/6272 439/607.47 |
| 2002/0031949 | A1 | 3/2002 | Miyazaki | |
| 2003/0171020 | A1 | 9/2003 | Shibata | |
| 2011/0230086 | A1 | 9/2011 | Fujiwara et al. | |
| 2015/0236441 | A1 | 8/2015 | Kim et al. | |
| 2015/0295346 | A1 | 10/2015 | Campbell et al. | |
| 2017/0025780 | A1 | 1/2017 | Kida | |

FOREIGN PATENT DOCUMENTS

| | | | |
|---|---|---|---|
| JP | H07122329 | A | 5/1995 |
| JP | 2017092034 | A | 5/2017 |

OTHER PUBLICATIONS

Chinese Office Action for CN Application No. 201880050296.4, dated Oct. 10, 2020.
Extended European Search Report for EP Application No. 18840534.4, dated Apr. 6, 2021, 11 pages.

* cited by examiner

SEALED CONNECTOR ASSEMBLY

CROSS-REFERENCE TO RELATED APPLICATION

This application is a national stage application under 35 U.S.C. § 371 of PCT Application Number PCT/US2018/042792 having an international filing date of Jul. 19, 2018, which designated the United States, said PCT application claiming the benefit of U.S. Provisional Patent Application No. 62/539,656 filed on Aug. 1, 2017, the entire disclosure of each which is hereby incorporated by reference.

TECHNICAL FIELD OF THE INVENTION

The invention relates to a sealed connector assembly, particularly to a sealed electrical connector assembly suited for hand mating by a human assembly operator.

BRIEF SUMMARY OF THE INVENTION

A connector assembly includes a female connector body, a male connector body defining a shroud configured to receive a forward portion of the female connector body, and a resilient seal axially surrounding the forward portion. The resilient seal is disposed intermediate the forward portion and the shroud and is in compressive contact with the forward portion and the shroud. The forward portion defines a forward retaining ledge on the forward portion. The forward retaining ledge extends inwardly from the forward portion. The resilient seal defines a forward retaining hook that extends outwardly and engages the forward retaining ledge.

In one embodiment, the connector assembly further includes a seal retainer that is attached to the female connector body. In this embodiment the resilient seal defines a seal lip that extends forward of the forward retaining hook. The seal lip is disposed intermediate the forward portion and the seal retainer and is in compressive contact with the forward portion and the seal retainer.

In one embodiment, a cavity is provided rearward of the resilient seal into which a rearward portion of the resilient seal can expand.

In one embodiment, the female connector body defines a retaining wall that circumferentially surrounds the forward portion and is configured to receive a portion of the shroud of the male connector body.

In one embodiment, the retaining ledge forms an acute angle relative to a longitudinal axis of the female connector body. In this embodiment, the retaining hook forms an obtuse angle relative to the longitudinal axis that is a supplementary angle to the acute angle.

In one embodiment, the seal lip and the forward retaining hook are formed integrally with the resilient seal.

In one embodiment, the resilient seal is asymmetrical about a lateral axis of the female connector body.

In one embodiment, the forward portion defines a rearward retaining ledge on a rearward end of the forward portion. The rearward retaining ledge extends outwardly from the forward portion. In this embodiment, the resilient seal defines a rearward retaining hook extending inwardly and engaging the rearward retaining ledge.

In one embodiment, the resilient seal is symmetrical about a lateral axis of the female connector body.

In one embodiment, the rearward retaining hook is formed integrally with the resilient seal.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

Reference will now be made in detail to embodiments, examples of which are illustrated in the accompanying drawings. In the following detailed description, numerous specific details are set forth in order to provide a thorough understanding of the various described embodiments. However, it will be apparent to one of ordinary skill in the art that the various described embodiments may be practiced without these specific details. In other instances, well-known methods, procedures, components, circuits, and networks have not been described in detail so as not to unnecessarily obscure aspects of the embodiments.

Presented herein is a sealed electrical connector assembly that is suited for robustly, reliably, and safely carrying electrical currents greater than 200 amperes.

Figure 1:
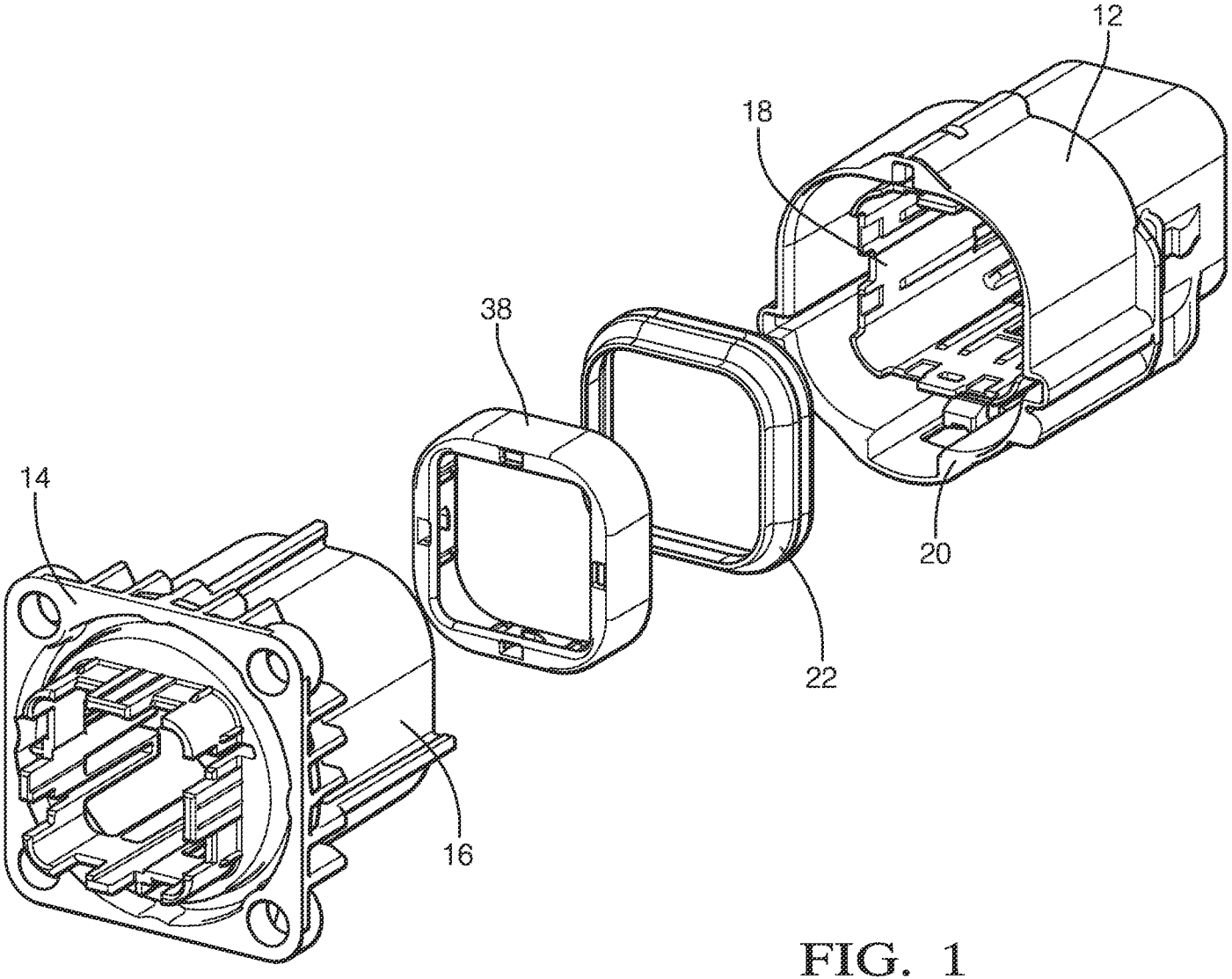
FIG. 1 is an exploded perspective view of a sealed connector assembly according to an embodiment of the invention.
Figure 2:
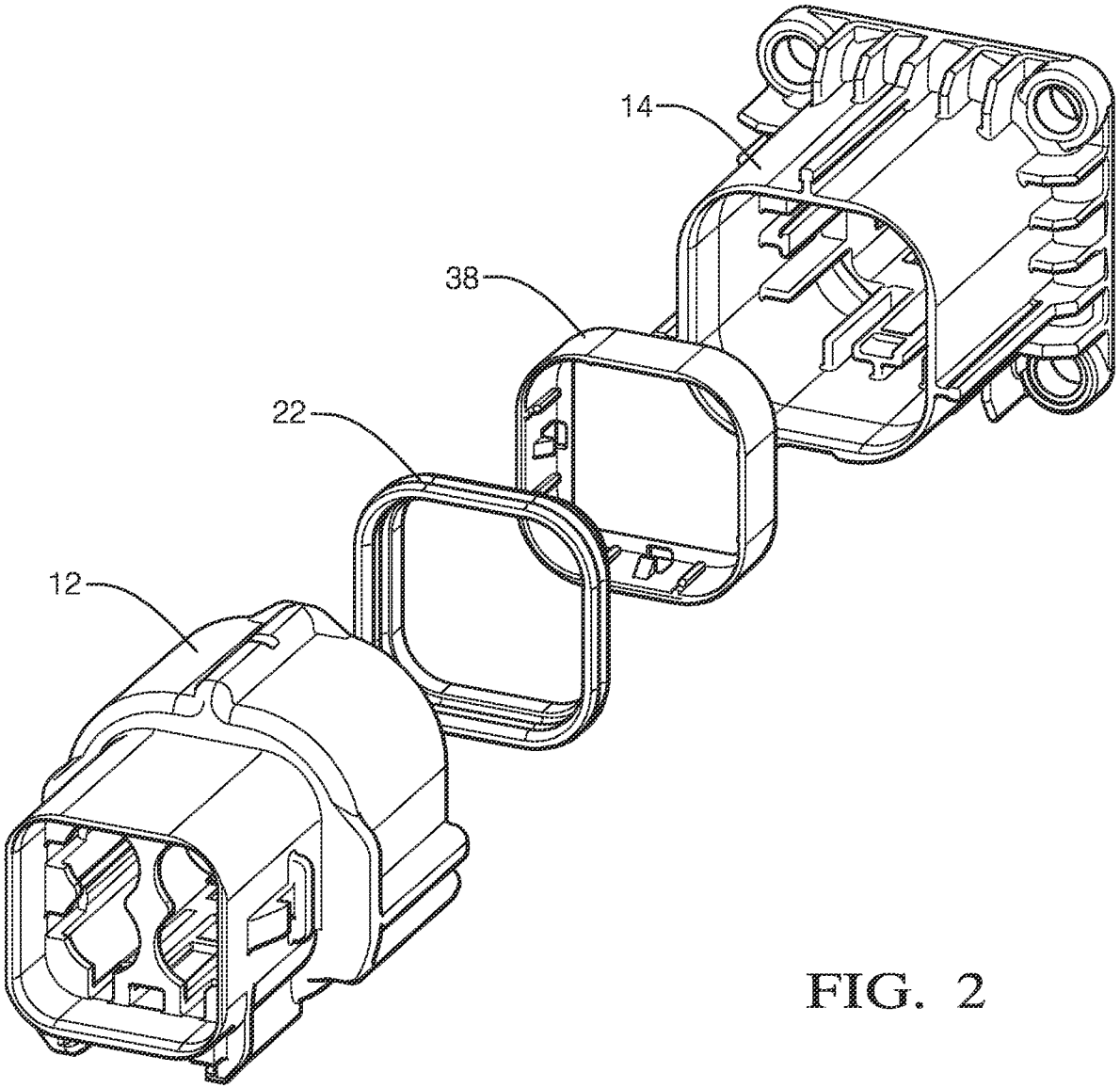
FIG. 2 is an alternate exploded perspective view of the sealed connector assembly of FIG. 1 according to an embodiment of the invention.
Figure 3A:
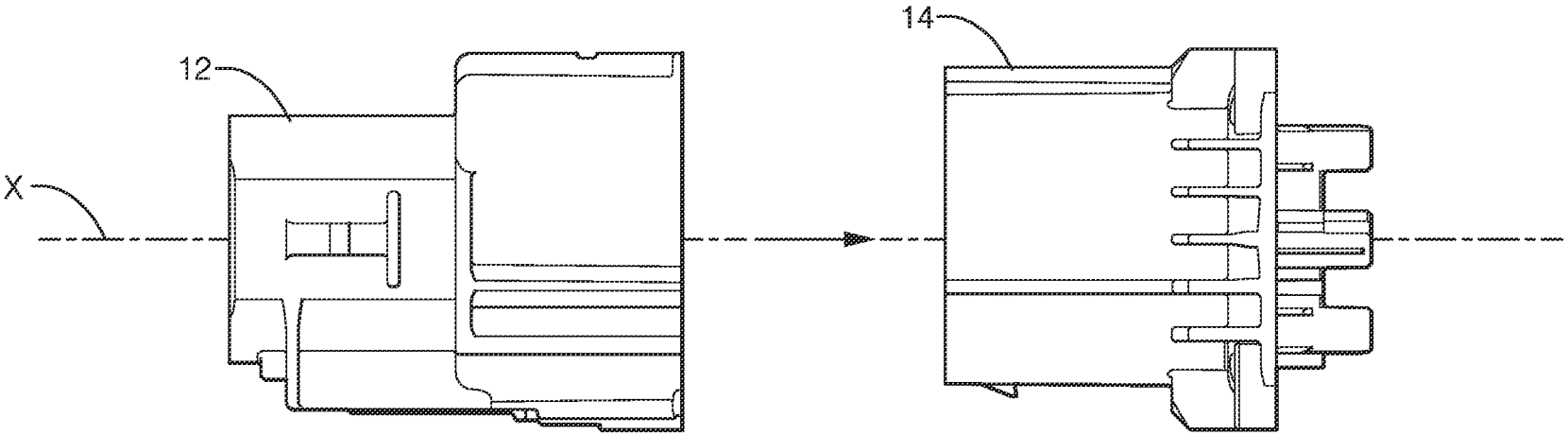
FIG. 3A is a side view of the sealed connector assembly of FIG. 1 in an unconnected configuration according to an embodiment of the invention.
Figure 3B:
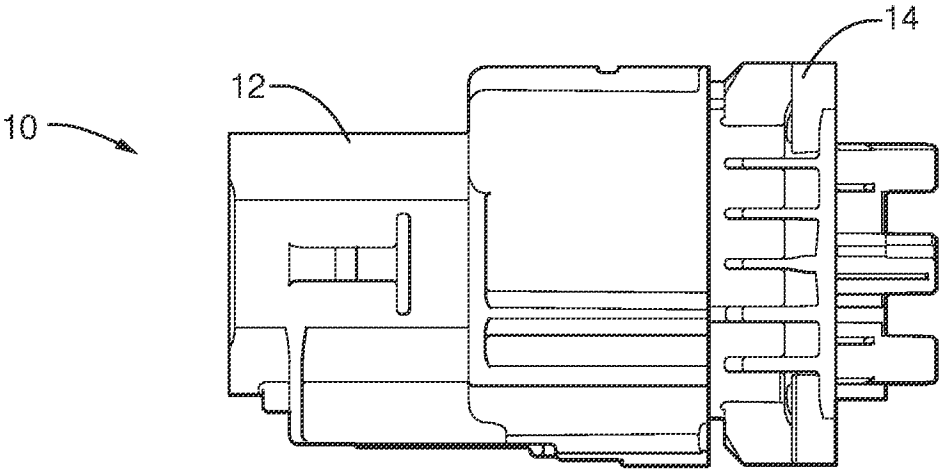
FIG. 3B is a side view of the sealed connector assembly of FIG. 1 in a connected configuration according to an embodiment of the invention.
Figure 4:
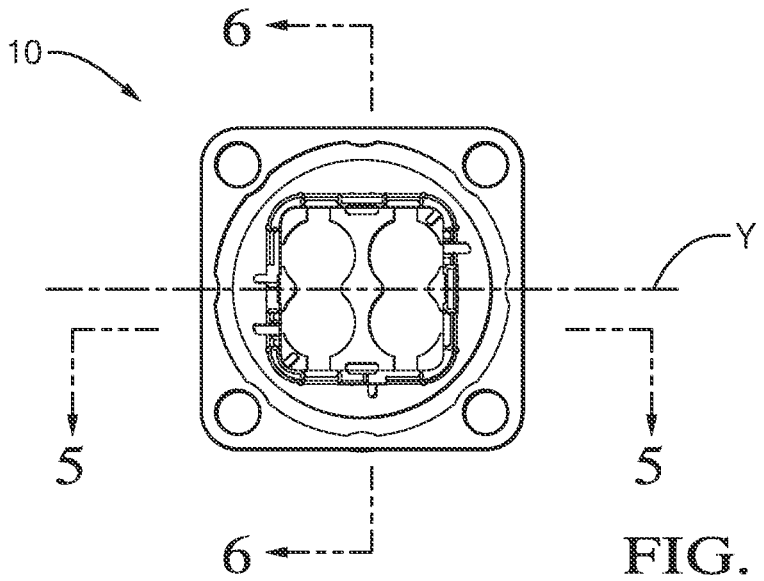
FIG. 4 is an end view of the sealed connector assembly of FIG. 1 in a connected configuration according to an embodiment of the invention.

FIGS. 1 and 2 of the drawings illustrate an embodiment of a connector assembly, hereinafter referred to as the assembly 10, that includes a female connector body 12, a male connector body 14 defining a header shroud, hereinafter referred to as the shroud 16, that is configured to receive a forward portion 18 of the female connector body 12. As used herein, forward refers to a location that is closer to a leading edge 20 of the female connector body 12 as it is inserted within the shroud 16 and forwardly refers to a direction towards the leading edge 20 of the female connector body 12 as shown in FIGS. 3A and 3B. Rearward refers to a location that further from the leading edge 20 of the female connector body 12 and rearwardly refers to a direction away from the leading edge 20 of the female connector body 12. In this particular example, the assembly 10 is an electrical connector assembly in which the female and male connector bodies 12, 14 contain mating electrical terminals.

Figure 5:
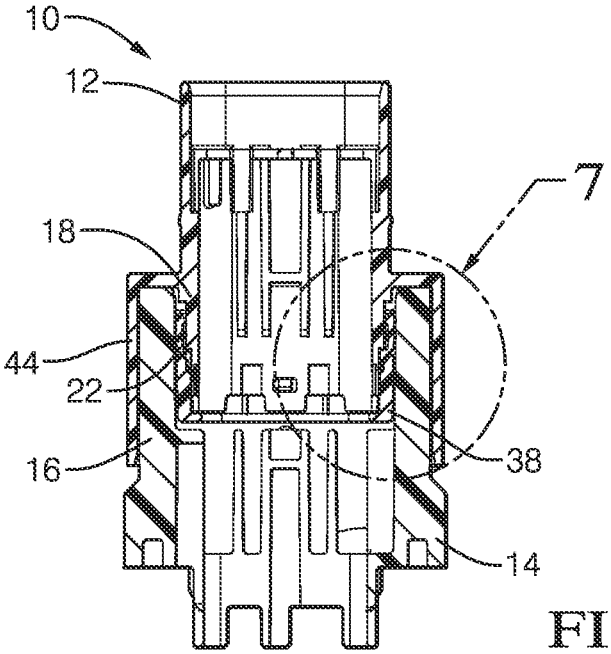
FIG. 5 is a cross section view of the sealed connector assembly of FIG. 1 along the section line B-B shown in FIG. 4 according to an embodiment of the invention.
Figure 6:
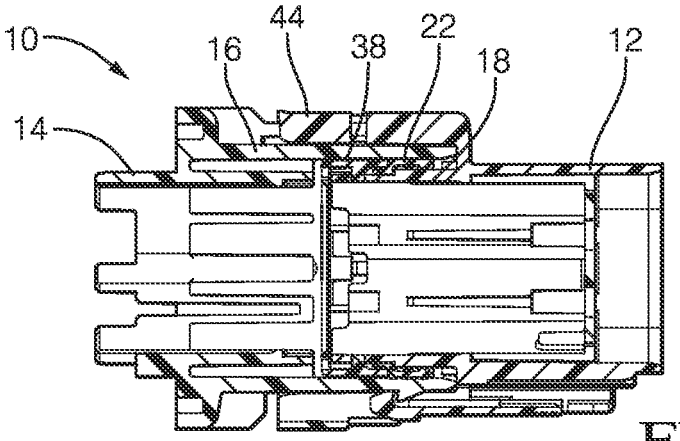
FIG. 6 is a cross section view of the sealed connector assembly of FIG. 1 along the section line C-C shown in FIG. 4 according to an embodiment of the invention.
Figure 7:
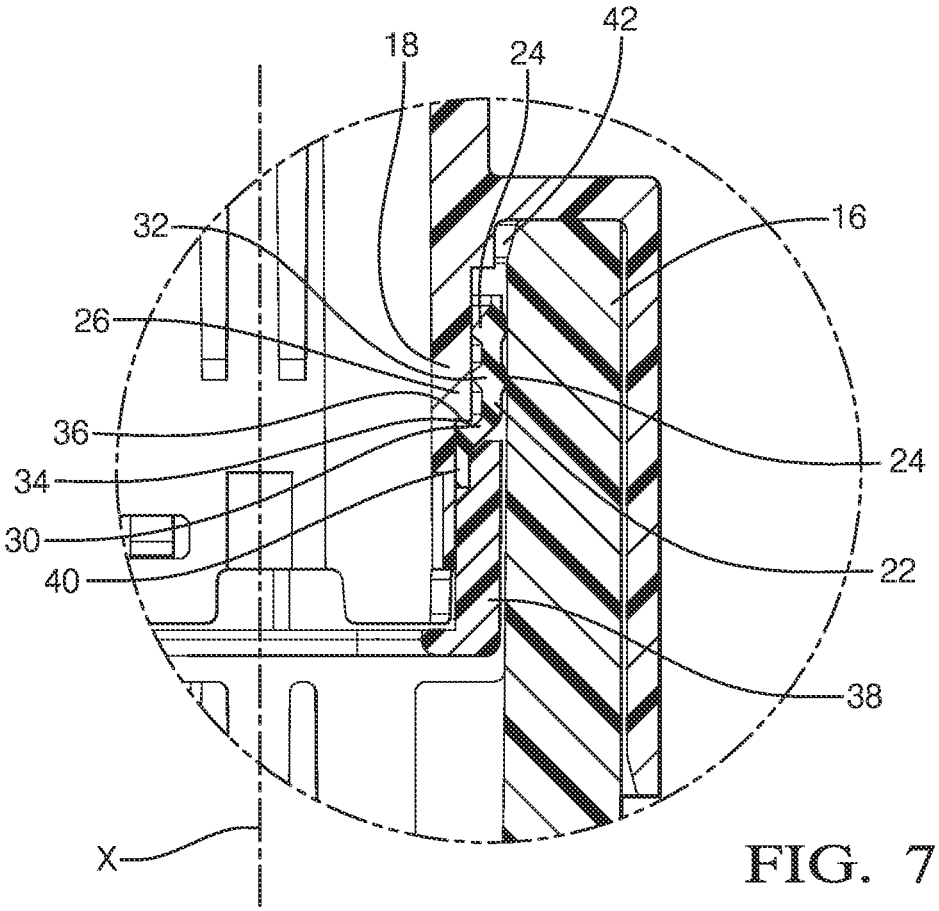
FIG. 7 is a close-up cross section view of the sealed connector assembly of FIG. 1 in the region D shown in FIG. 5 according to an embodiment of the invention.

As illustrated in FIG. 5, a resilient seal, hereinafter referred to as the seal 22, that is formed of a compliant material, such as silicone rubber, axially surrounds the forward portion 18 of the female connector body 12. The seal 22 is disposed intermediate the forward portion 18 and the shroud 16. The seal 22 defines circumferential ribs 24 on the outward and inward surfaces of the seal 22 and these ribs 24 are in compressive contact with both the forward portion 18 and the shroud 16 to inhibit the intrusion of environmental contaminants, such as water or dirt, into the female and male connector bodies 12, 14. As shown in FIG. 7, the seal 22 is asymmetrical about a lateral axis Y of the connector body. As used herein, the lateral axis Y is normal, i.e., perpendicular, to the longitudinal axis X.

As best shown in FIG. 7, a forward portion 18 of the female connector body 12 defines a forward retaining ledge 26 on the forward portion 18 of the female connector body 12 that extends inwardly from the forward portion 18. In the illustrated example, the forward retaining ledge 26 extends circumferentially around the forward portion 18. The seal 22 defines a forward retaining hook 30 that extends outwardly from an inner surface 32 of the seal 22. The forward retaining hook 30 is integrally formed with the seal 22. The forward retaining hook 30 is configured to engage the forward retaining ledge 26 and inhibit rearward movement of the seal 22 as the female connector body 12 is mated with the male connector body 14. As used herein, inward refers to a direction toward the longitudinal axis X of the female connector body 12 and outward refers to a direction away from the longitudinal axis X. The forward retaining ledge 26 is forwardly angled, i.e., forming an acute angle 34 relative to the longitudinal axis X. The forward retaining hook 30 rearwardly angled, i.e., forming an obtuse angle 36 relative to the longitudinal axis X that is substantially supplementary to the acute angle 34. As used herein, substantially supplementary means that the angular value of the acute angle 34 plus the angular value of the obtuse angle 36 in equal to 180°±2°. The obtuse angle 36 of the forward retaining hook 30 engages the acute angle 34 of the forward retaining ledge 26 in order to better keep the seal 22 in place as the female connector body 12 is inserted within the shroud 16.

A seal retainer 38 is attached to the female connector body 12 to retain the seal 22 in the proper position on the female connector body 12. The seal 22 defines a seal lip 40 that extends forward of the forward retaining hook 30. When the female connector body 12 is received within the shroud 16 of the male connector body 14, the seal lip 40 is disposed intermediate the forward portion 18 and the seal retainer 38 and is in compressive contact with the forward portion 18 and the seal retainer 38. The seal lip 40 is integrally formed with the seal 22.

As also best shown in FIG. 7, the female connector body 12 defines space or cavity 42 is provided rearward of the seal 22 into which a rearward portion of the seal 22 can expand as friction between the shroud 16 and the seal 22 pulls the seal 22 rearward as the female connector body 12 is mated with the male connector body 14 as shown in FIGS. 3A and 3B. This cavity 42 extends circumferentially around the female connector body 12.

The female connector body 12 defines a retaining wall 44 circumferentially surrounding the forward portion 18 and configured to receive a portion of the shroud 16 of the male connector body 14.

The inventors have discovered that the seal 22 of the assembly does not the exhibit the pinching, bunching, and rolling seen in seals of prior art connector assembles which lack the retaining hook 30 and the cavity 42 rearward of the seal 22. Without subscribing to any particular theory of operation, the retention of the seal 22 by the forward retaining ledge 26 and forward retaining hook 30 and the cavity 42 rearward of the seal 22 cooperate to provide these benefits. The seal 22 also provides a lower engagement force between the seal 22 and the male connector body 14 and less sensitivity to seal gap than prior art seals as shown in Table 1 below. A reduction in engagement force also offers improved ergonomics for hand mating of the connector assembly by a human assembly operator.

TABLE 1

Engagement Force Comparison

| Connector Assembly 10 Engagement Force | | Prior Art Connector Assembly Engagement Force | |
|---|---|---|---|
| At nominal seal gap dimension | 23N | At nominal seal gap dimension | 27N |
| At gap 0.1 mm less than nominal | 29N | At gap 0.1 mm less than nominal | 36N |
| At gap 0.2 mm less than nominal | 37N | At gap 0.2 mm less than nominal | 100N |

Figure 8:
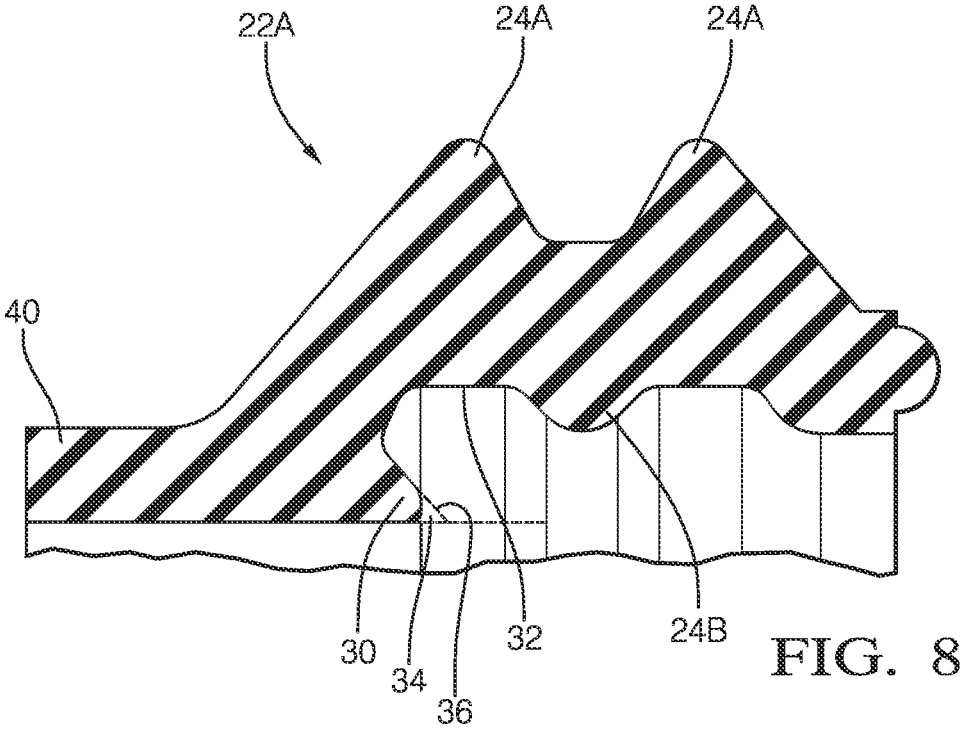
FIG. 8 is cross section view of a first alternate seal profile according to an embodiment of the invention.
Figure 9:
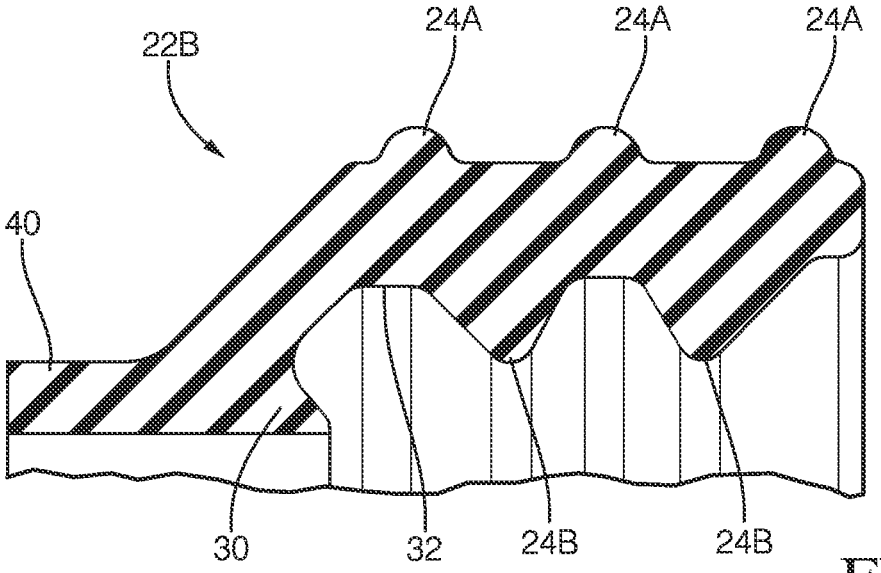
FIG. 9 is cross section view of a second alternate seal profile according to an embodiment of the invention.

FIGS. 8 and 9 illustrate cross sections of two alternative embodiments of asymmetrical seal designs. The seal 22A of FIG. 8 includes two outer ribs 24A that contact the shroud 16 of the male connector body 14 and one inner rib 24B that contacts the forward portion 18 of the female connector body 12. The seal 22B of FIG. 9 includes three outer ribs 24A that contact the shroud 16 of the male connector body 14 and two inner ribs 24B that contact the forward portion 18 of the female connector body 12. Both of these seal designs are asymmetrical about a lateral axis Y of the female connector body 12.

Figure 10:
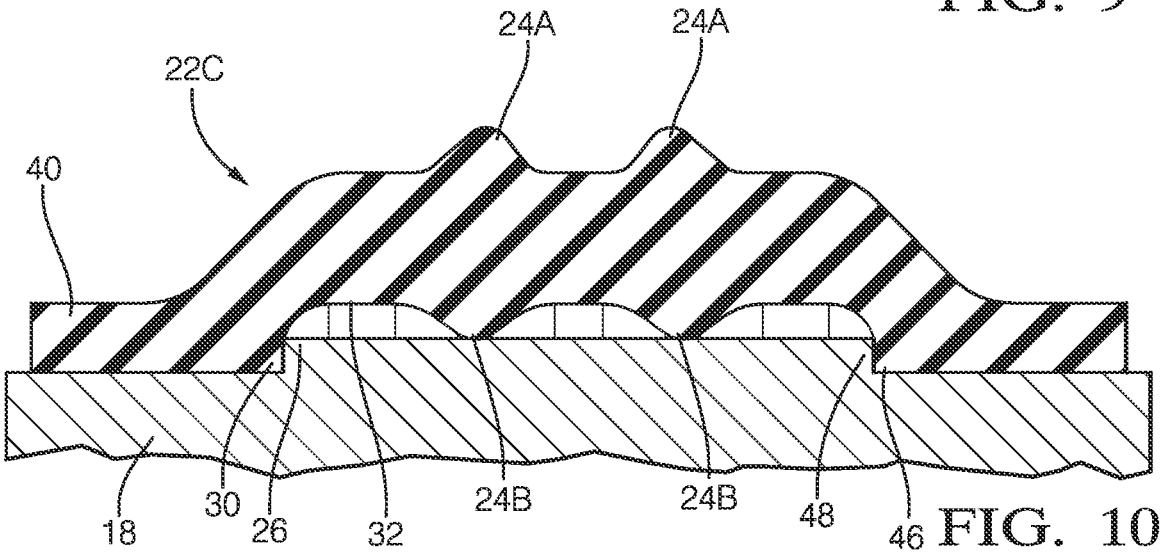
FIG. 10 is cross section view of a third alternate seal profile according to an embodiment of the invention.
Figure 11:
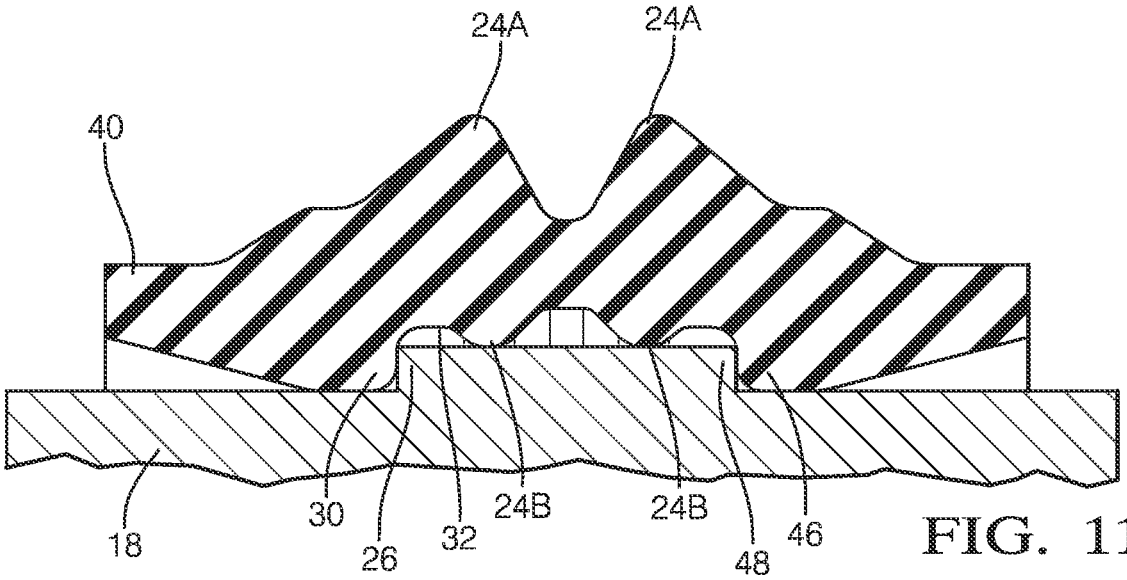
FIG. 11 is cross section view of a fourth alternate seal profile according to an embodiment of the invention.

FIGS. 10 and 11 illustrate two alternative embodiments of symmetrical seal designs. These symmetrical seal designs include an additional rearward retainer hook 46 that may engage a rearward retainer ledge 48 of the forward portion 18 of the female connector body 12. The seals 22C, 22D of FIGS. 10 and 11 include two outer ribs 24A that contact the shroud 16 of the male connector body 14 and two inner ribs 24B that contact the forward portion 18 of the female connector body 12. Both of these seal designs are symmetrical about a lateral axis Y of the female connector body 12.

While the example presented herein is directed to an electrical connector assembly, other embodiments may be envisioned that are adapted for use with other types of connector assemblies for fiber optic cables, pneumatic tubes, hydraulic tubes, or a hybrid connector assembly including two or more of the items listed above.

While this invention has been described in terms of the preferred embodiments thereof, it is not intended to be so limited, but rather only to the extent set forth in the claims that follow. For example, the above-described embodiments (and/or aspects thereof) may be used in combination with each other. In addition, many modifications may be made to configure a particular situation or material to the teachings of the invention without departing from its scope. Dimensions, types of materials, orientations of the various components, and the number and positions of the various components described herein are intended to define parameters of certain embodiments and are by no means limiting and are merely prototypical embodiments.

Many other embodiments and modifications within the spirit and scope of the claims will be apparent to those of skill in the art upon reviewing the above description. The scope of the invention should, therefore, be determined with reference to the following claims, along with the full scope of equivalents to which such claims are entitled.

As used herein, 'one or more' includes a function being performed by one element, a function being performed by more than one element, e.g., in a distributed fashion, several functions being performed by one element, several functions being performed by several elements, or any combination of the above.

It will also be understood that, although the terms first, second, etc. are, in some instances, used herein to describe various elements, these elements should not be limited by these terms. These terms are only used to distinguish one element from another. For example, a first contact could be termed a second contact, and, similarly, a second contact could be termed a first contact, without departing from the scope of the various described embodiments. The first contact and the second contact are both contacts, but they are not the same contact.

The terminology used in the description of the various described embodiments herein is for the purpose of describing particular embodiments only and is not intended to be limiting. As used in the description of the various described embodiments and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

As used herein, the term "if" is, optionally, construed to mean "when" or "upon" or "in response to determining" or "in response to detecting," depending on the context. Similarly, the phrase "if it is determined" or "if [a stated condition or event] is detected" is, optionally, construed to mean "upon determining" or "in response to determining" or "upon detecting [the stated condition or event]" or "in response to detecting [the stated condition or event]," depending on the context.

Additionally, while terms of ordinance or orientation may be used herein these elements should not be limited by these terms. All terms of ordinance or orientation, unless stated otherwise, are used for purposes distinguishing one element from another, and do not denote any particular order, order of operations, direction or orientation unless stated otherwise.

We claim:

1. A connector assembly, comprising:

a female connector body;

a male connector body defining a shroud configured to receive a forward portion of the female connector body;

a resilient seal axially surrounding the forward portion, said resilient seal disposed intermediate the forward portion and the shroud and in compressive contact with the forward portion and the shroud, wherein the resilient seal defines a seal lip extending forward of a forward retaining hook, wherein the forward portion defines a forward retaining ledge on the forward portion, said forward retaining ledge extending inwardly from the forward portion, and the resilient seal defines a forward retaining hook extending outwardly and engaging said forward retaining ledge, and wherein the resilient seal is symmetrical about a lateral axis of the female connector body; and a seal retainer that is attached to the forward portion, wherein the seal lip is disposed intermediate the forward portion and the seal retainer and is in compressive contact with the forward portion and the seal retainer, wherein the forward portion defines a rearward retaining ledge on a rearward end of the forward portion, said rearward retaining ledge extending outwardly from the forward portion and wherein the resilient seal defines a rearward retaining hook extending inwardly and engaging said rearward retaining ledge.

2. The connector assembly according to claim 1, wherein a cavity is provided rearward of the resilient seal into which a rearward portion of the resilient seal can expand.

3. The connector assembly according to claim 1, wherein the female connector body defines a retaining wall circumferentially surrounding the forward portion and configured to receive a portion of the shroud of the male connector body.

4. The connector assembly according to claim 1, wherein the seal lip and the forward retaining hook is formed integrally with the resilient seal.

5. The connector assembly according to claim 1, wherein the forward portion defines a rearward retaining ledge on a rearward end of the forward portion, said rearward retaining ledge extending outwardly from the forward portion and wherein the resilient seal defines a rearward retaining hook extending inwardly and engaging said rearward retaining ledge.

6. The connector assembly according to claim 1, wherein the resilient seal is asymmetrical about a lateral axis of the female connector body.

7. The connector assembly according to claim 6, wherein the forward retaining hook is formed integrally with the resilient seal.

8. The connector assembly according to claim 6, wherein the forward retaining ledge is forwardly angled, and the forward retaining hook is rearwardly angled.

9. The connector assembly according to claim 6, wherein the forward retaining hook is in intimate contact with the forward retaining ledge.

10. The connector assembly according to claim 1, wherein a cavity is provided rearward of the resilient seal into which a rearward portion of the resilient seal can expand.

11. The connector assembly according to claim 1, wherein the female connector body defines a retaining wall circumferentially surrounding the forward portion and configured to receive a portion of the shroud of the male connector body.

12. The connector assembly according to claim 1, wherein the seal lip and the forward retaining hook is formed integrally with the resilient seal.

13. The connector assembly according to claim 1, wherein the rearward retaining ledge is forwardly angled, and the rearward retaining hook is forwardly angled.

14. The connector assembly according to claim 1, wherein the rearward retaining hook is in intimate contact with the rearward retaining ledge.

* * * * *